United States Patent [19]

Nicholas

[11] 4,297,053

[45] Oct. 27, 1981

[54] GUTTERING

[75] Inventor: Terry G. Nicholas, Berkshire, England

[73] Assignee: Wavin B.V., Zwolle, Netherlands

[21] Appl. No.: 105,401

[22] Filed: Dec. 19, 1979

[30] Foreign Application Priority Data

Dec. 20, 1978 [GB] United Kingdom ..... 49375/78

[51] Int. Cl.[3] ..... E02B 9/04

[52] U.S. Cl. ..... 405/121; 52/11; 52/16

[58] Field of Search ..... 405/121, 122, 123; 52/11, 16, 12–15

[56] References Cited

U.S. PATENT DOCUMENTS

| | | | |
|---|---|---|---|
| 3,355,895 | 12/1967 | Bayes et al. | 52/11 X |
| 3,611,731 | 10/1971 | Edmondson | 52/11 X |
| 3,670,505 | 6/1972 | Weaver | 52/11 X |

FOREIGN PATENT DOCUMENTS

| | | | |
|---|---|---|---|
| 1709053 | 5/1971 | Fed. Rep. of Germany . | |
| 1539890 | 8/1968 | France . | |
| 2053486 | 4/1971 | France . | |
| 841369 | 7/1960 | United Kingdom | 405/121 |
| 1244968 | 9/1971 | United Kingdom . | |
| 1304526 | 1/1973 | United Kingdom . | |

*Primary Examiner*—Dennis L. Taylor

*Attorney, Agent, or Firm*—Wilkinson, Mawhinney & Theibault

[57] ABSTRACT

A gutter fitting 1 comprises a body member 2 defining a channel for receiving a gutter length. A sealing member 6 extends through a slot 7 in the body member and has a sealing portion 10 for sealing against the gutter length and a retaining portion 11 which extends transversely of the slot 7 and is clamped in a passage 12 between the body member 2 and a clip 13 which snap fits over the opposite longitudinal edges—one edge 8 only shown—of the channel to clamp the gutter length in the channel. The sealing member is thereby adequately retained in the fitting against displacement.

13 Claims, 4 Drawing Figures

GUTTERING

This invention relates to guttering and more particularly to gutter fittings.

Known gutter fittings, such as gutter support brackets, unions and downpipe connectors include a channel for receiving a length of gutter therein and have a sealing member protruding inwardly of the channel for sealing against the gutter length.

An object of this invention is to provide such a fitting in which the sealing member is adequately retained in the fitting against displacement for example during the fitting of guttering in the fitting.

In accordance with the present invention, there is provided a gutter fitting comprising a body member defining a channel for receiving therein a gutter length, a sealing member extending through a slot in said body member, said sealing member having a sealing portion protruding inwardly of said channel for sealing against a gutter length therein in use and a retaining portion extending transversely of said slot and located within a passage defined between the body member and a retaining member extending over the outside of said body member to retain said sealing member in said fitting.

In order that the invention may be well understood, some embodiments thereof, which are given by way of example only, will now be described, reference being had to the accompanying drawings, in which.

Like parts of the gutter fittings have been given like reference numerals in the drawings.

Each of the illustrated gutter fittings forms a combined union and support bracket. Each fitting 1 has an injection moulded plastics body member 2 defining a channel, the opposite ends 3, 4 of which receive the end portions of respective rainwater gutter lengths (not shown). The body member has a bracket 5 integrally moulded therewith to enable the body member to be secured to a facia board (not shown) of a building.

Figure 1:
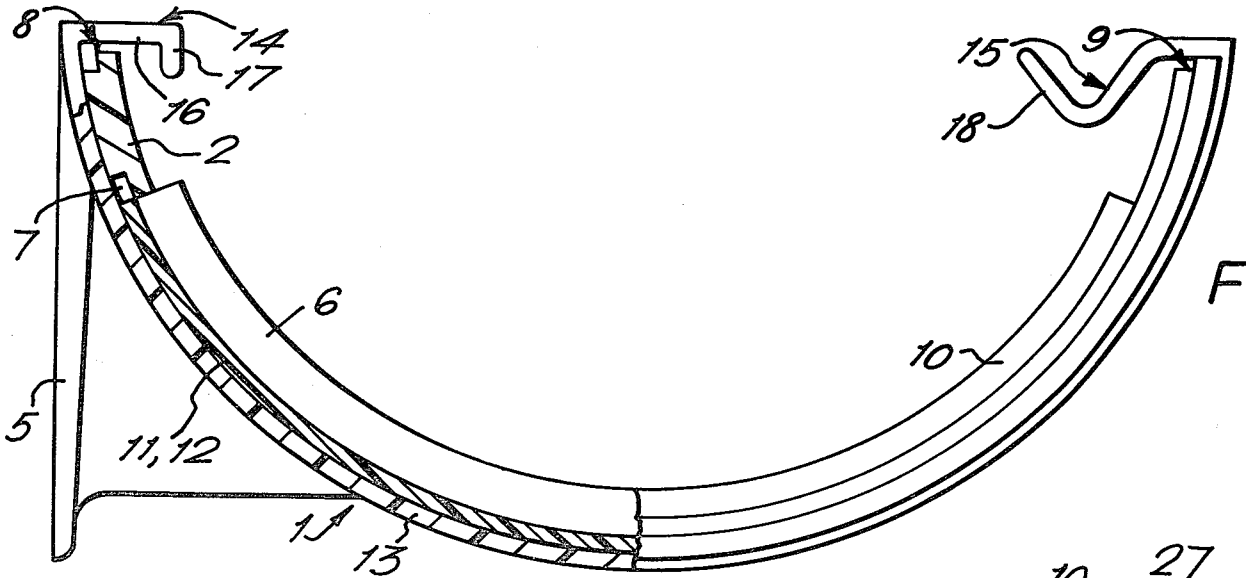
FIG. 1 is a part sectional side elevation of a gutter fitting.

A respective sealing member is provided at each end 3, 4 of the channel for sealing against a gutter length therein. The sealing member 6 at end 3 is illustrated in the drawings and extends through a slot 7 in the body member 2, the slot and sealing member extend transversely of the opposite longitudinal edges 8, 9 of the channel stopping short of those edges. The sealing member has a sealing portion 10, illustrated as being ribbed, protruding inwardly of the channel end 3 and a retaining portion 11 which extends transversely of the slot, on both sides thereof in the illustrated fitting, and is located within a passage 12 defined between the body member 2 and a retaining member which is formed as a clip 13 which is detachably attached to and extends between the longitudinal edges 8, 9 over the outside of the body member. To securely retain the sealing member 6 within the fitting, the retaining portion is clamped in the passage 12 between the body member 1 and the clip 13. The clip 13 is advantageously snap-fittable to the opposite longitudinal edges 8, 9 of the channel by means of end portions 14 and 15 which overlie those longitudinal edges for engaging over the corresponding edges of a gutter length and clamping the gutter length in sealing engagement with the sealing portion. As shown in FIG. 1, the end portion 14 comprises a channel shaped nib comprising, as viewed in that Figure, an inward projection 16 which terminates with a downward projection 17. The other end portion 15, which is remote from the bracket 5, has a more resilient configuration comprising a substantially S-shaped profile which is more easily snap-fitted to the body member as engagement of free end 18 with the outside of the body member during fitting resiliently deflects the end portion 15. In use, the end portion 14 of the clip is fitted over the channel edge 8 and the corresponding edge of a gutter length after the body member has been secured to a facia board using the bracket 5. Thereafter the end portion 15 is snap-fitted over the channel edge 9 and the corresponding gutter length edge.

It is envisaged that both end portions 14 and 15 might conveniently be provided with the substantially S-shaped profile shown only for end portion 15 in FIG. 1.

Figure 4:
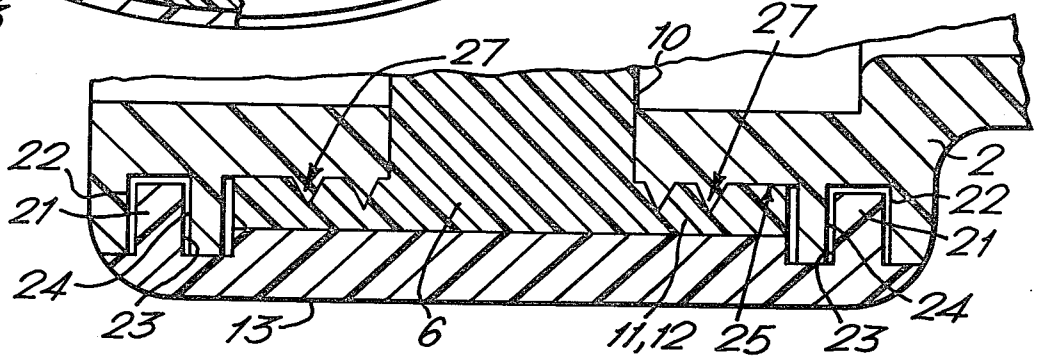
FIG. 4 is an enlarged detail of a view similar to FIG. 2 of another gutter fitting.

It will be noted that in each of the illustrated fittings, the clip 13 is provided with inwardly projecting portions which engage the body member 1 on each respective side of the slot to limit any tendency for the slot to widen in use, which widening would be detrimental to the retention of the sealing member within the fitting. More particularly, the clips illustrated in FIGS. 2 and 3 have inwardly projecting side edge portions 19 which engage side portions 20 of the body member. The portions 19 and 20 being tapered so that the fit of the clip 13 can be arranged to urge the slot to narrow. The clip illustrated in FIG. 4 is provided with inwardly projecting ribs 21 which engage in grooves 22 in the body member, engagement of the inner faces 23 of the ribs with the adjacent side faces 24 of the grooves preventing the slot widening. The ribs 21 have a clearance fit with the grooves (shown in an exaggerated manner in the drawing) to ensure proper assembly of the fitting.

Figure 2:
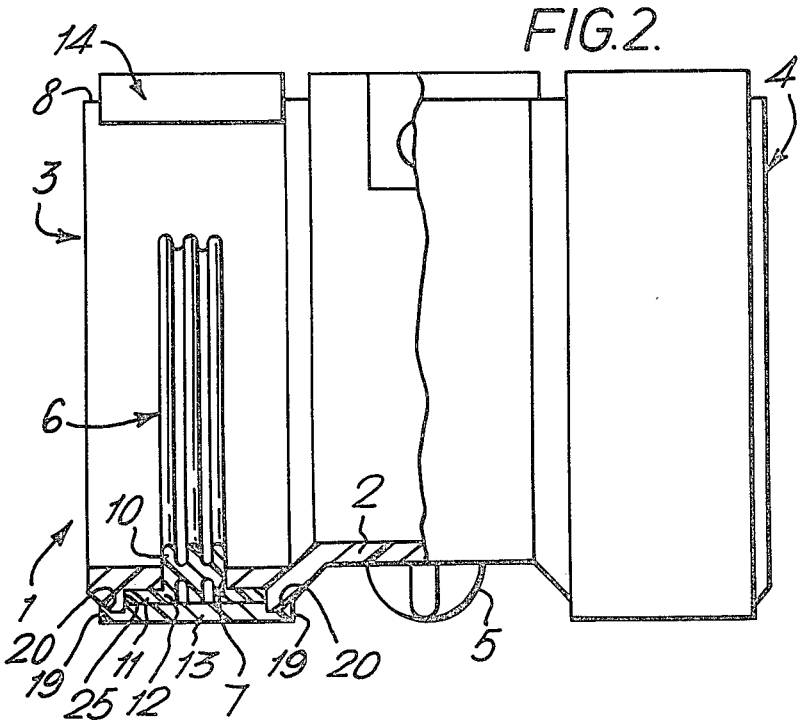
FIG. 2 is a part sectional front elevation of the same gutter fitting.
Figure 3:
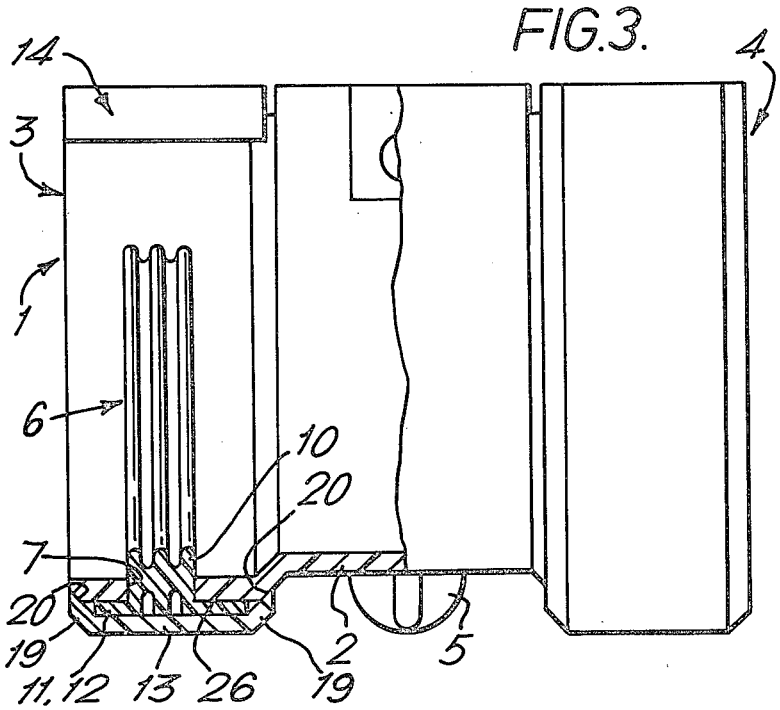
FIG. 3 is a view similar to FIG. 2 of another gutter fitting.

In FIG. 2 and FIG. 4 the passage 12 between the body member 2 and the clip includes a recess 25 opposite the clip in the outside of the body member, the retaining portion 11 of the sealing member and an adjacent portion of the clip being located within the recess. The fitting shown in FIG. 3, however, is not provided with such a recess. The retaining portion of the sealing member is clamped against the outside surface 26 of the body member, and as shown the ends of the passage 12 defined between the surface 26 and the clip are closed by the edge portions 19 of the clip.

The fitting shown in FIG. 4 has the retaining portion 11 of the sealing member and the base of the recess 25 provided with interengaging ribs and grooves 27 which provide a water barrier should water pass between the sealing portion 10 and the gutter length engaged thereby.

It is to be understood that whilst the illustrated gutter fittings are for guttering of half-round cross-section, they could be formed for guttering of so-called 'rectilinear' cross-section in which the cross-section of the guttering has a shape formed by a number of straight lines—typically a half octagon.

I claim:

1. A gutter fitting comprising a body member defining a channel for receiving therein a gutter length, a sealing member extending through a slot in said body member, said sealing member having a sealing portion protruding inwardly of said channel for sealing against a gutter length therein in use and a retaining portion extending transversely of said slot and located within a passage defined between the body member and a retaining member extending over the outside of said body member to retain said sealing member in said fitting.

2. A gutter fitting as claimed in claim 1, wherein said retaining portion is clamped in said passage between the body member and the retaining member.

3. A gutter fitting as claimed in claims 1 or 2, wherein said passage includes a recess in the body member opposite said retaining member.

4. A gutter fitting as claimed in claim 2, wherein the retaining portion of the sealing member and the body member are provided with interengaging ribs and grooves.

5. A gutter fitting as claimed in claim 1, wherein said retaining member has inwardly projecting portions which engage said body member on each respective side of the slot to limit any tendency for the slot to widen in use.

6. A gutter fitting as claimed in claim 5, wherein said inwardly projecting portions engage in respective grooves in said body member.

7. A gutter fitting as claimed in claim 5, wherein said inwardly protecting portions comprise side edge portions of said retaining member which engage side portions of the body member.

8. A gutter fitting as claimed in claim 1, wherein said retaining member comprises a clip detachably attached to and extending between opposite longitudinal edges of said channel.

9. A gutter fitting as claimed in claim 5, wherein said clip is snap-fittable to the opposite longitudinal edges of said channel and has end portions which overlie said longitudinal edges for clamping a gutter length in said channel in sealing engagement with said sealing portion of the sealing member.

10. A gutter fitting as claimed in claim 9, wherein at least one of the end portions of said clip has a substantially S-shaped profile to assist snap-fitting thereof to the body member.

11. A gutter fitting as claimed in claim 1, wherein said body member has a half-round cross-section.

12. A gutter fitting as claimed in claim 1, wherein said body member has a rectilinear cross-section.

13. A gutter fitting as claimed in claim 1, wherein said sealing portion of the sealing member is ribbed.

* * * * *